US005357769A

United States Patent [19]

Crabtree et al.

[11] Patent Number: 5,357,769

[45] Date of Patent: Oct. 25, 1994

[54] BOTTOM MOUNT REFRIGERATOR AIR RETURN SYSTEM

[75] Inventors: John Crabtree; Daryl L. Harmon, both of Evansville, Ind.

[73] Assignee: Whirlpool Corporation, Benton Harbor, Mich.

[21] Appl. No.: 58,827

[22] Filed: May 10, 1993

[51] Int. Cl.[5] ..... F25D 11/02

[52] U.S. Cl. ..... 62/441; 62/186

[58] Field of Search ..... 62/441, 186, 187, 443

[56] References Cited

U.S. PATENT DOCUMENTS

| | | | |
|---|---|---|---|
| 2,350,249 | 5/1944 | Osborn | 62/5 |
| 2,451,903 | 10/1948 | Bauman | 62/1 |
| 2,907,180 | 10/1959 | Mann | 62/155 |
| 3,005,321 | 10/1961 | Devery | 62/186 |
| 3,107,502 | 10/1963 | Herndon et al. | 62/441 |
| 3,169,383 | 2/1965 | Morton et al. | 62/419 |
| 3,232,071 | 2/1966 | Wallenbrock et al. | 62/441 |
| 3,364,694 | 1/1968 | Cohen et al. | 62/265 |
| 4,077,229 | 3/1978 | Gelbard et al. | 62/441 |
| 4,229,945 | 10/1980 | Griffin et al. | 62/229 |
| 4,920,765 | 5/1990 | McCauley et al. | 62/408 |

*Primary Examiner*—Ronald C. Capossela

*Attorney, Agent, or Firm*—Thomas J. Roth; Stephen D. Krefman; Robert O. Rice

[57] ABSTRACT

A refrigerator includes an improved air return system providing a channel of air below the crisper pans. Particularly, a separator top is positioned above a separator insulation body to define a space therebetween providing an air flow path for channeling return air flow. An inlet to the space is positioned proximate the front of the separator wall and an outlet is positioned proximate the rear of the separator. An air flow passage through the separator is in communication with the outlet for returning refrigerated air to the freezer compartment.

14 Claims, 5 Drawing Sheets

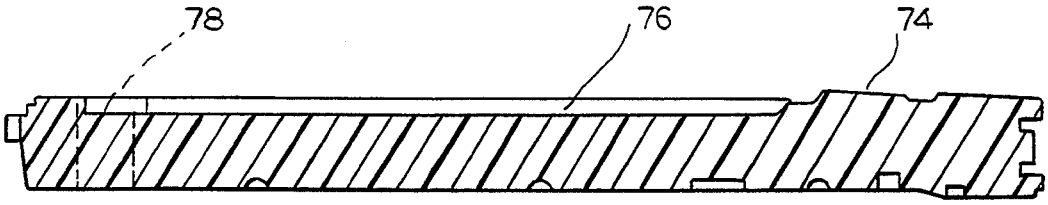
FIG. 6
FIG. 7
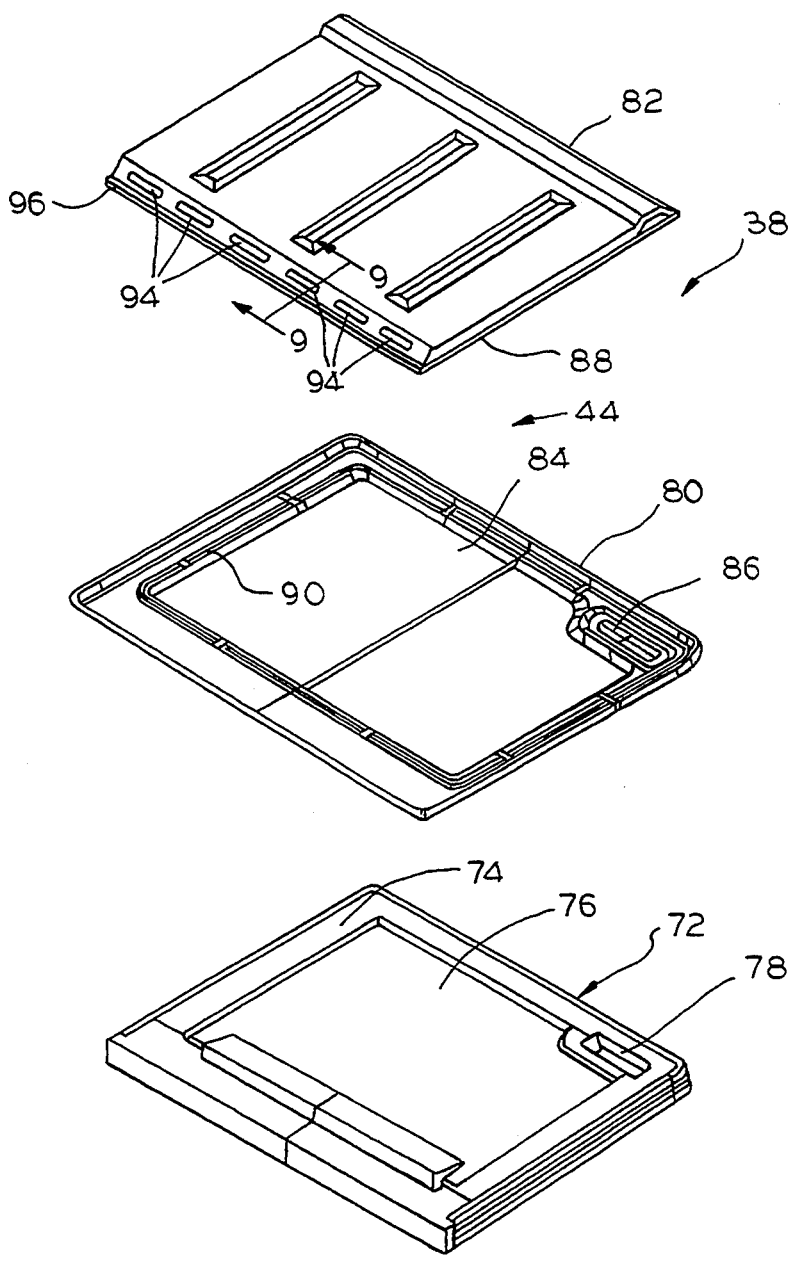

BOTTOM MOUNT REFRIGERATOR AIR RETURN SYSTEM

FIELD OF THE INVENTION

This invention relates to a refrigeration apparatus and, more particularly, to a bottom mount refrigerator air return system.

BACKGROUND OF THE INVENTION

Conventional frostless-type refrigerators utilize forced refrigerated air flow to cool fresh food and freezer compartments. An electric fan draws refrigerated air across an evaporator coil, with most of the air being forced into the freezer compartment and then returned to the evaporator. Some of the refrigerated air is delivered to the fresh food compartment through an air inlet opening therein. A damper may be provided at the air inlet opening that is typically located at the upper central portion of a rear wall in the fresh food compartment. Suitable air return openings are provided for returning air from the fresh food compartment to the evaporator.

A refrigeration apparatus in one known form comprises a refrigerator/freezer having a bottom mount freezer. Particularly, a separator or divider including a rigid body of insulation sandwiched between a top wall and a bottom wall, each of plastic or metal, separates the two compartments. The air return opening is provided through the separator, usually at a rear corner. Thus, while air may freely circulate through the fresh food compartment, the most direct path from the inlet to the return is along the back wall of the fresh food compartment.

A typical refrigeration apparatus includes storage pans, often called crisper pans, slidably mounted at the bottom of the fresh food compartment. Thus, they are spaced a very short distance above the separator. With a bottom mount unit, the temperature below the crisper pans can be quite cold due to proximity to the freezer compartment. This problem is typically solved by adding a foil heater between the separator insulation and top wall or by increasing insulation thickness. Such a heater increases energy costs, both for running the heater itself and the increased time which the compressor must be run to compensate for added heat.

The present invention overcomes the above problems of prior refrigeration apparatus, in a novel and simple manner.

SUMMARY OF THE INVENTION

In accordance with the invention, a refrigeration apparatus is provided with an air return system for channeling air across the bottom of a fresh food compartment.

Broadly, there is disclosed herein an improved air return system in a refrigeration apparatus including a cabinet defining a fresh food compartment above a freezer compartment separated by an insulated separator. Means are included for providing refrigerated air to the freezer compartment, and air flow control means for selectively directing a portion of the refrigerated air to the fresh food compartment. The air return system includes a separator top operatively associated with the separator in the fresh food compartment and including return means defining an air flow path for channeling return air flow. The return means includes an inlet proximate the front of the separator and an outlet proximate the rear of the separator. An air flow passage through the separator is in communication with the outlet for returning refrigerated air to the freezer compartment.

In accordance with one aspect of the invention, the separator top comprises a one-piece wall positioned atop separator and defining an air space therebetween and the inlet comprises an opening in the wall proximate a front edge of the wall.

There is disclosed in accordance with another aspect of the invention a separator top comprising a first wall positioned atop the separator and a second wall positioned atop the first wall defining an air space therebetween and the inlet comprises an opening in the second wall proximate a front edge of the second wall.

It is a feature of the invention that the outlet comprises an opening in the first wall proximate a rear edge of the first wall.

It is another feature of the invention to provide a tubular element connected to the first wall at the outlet and extending through the air flow passage.

More particularly, there is disclosed herein an improved air return system in a refrigeration apparatus including a cabinet defining a fresh food compartment above a freezer compartment separated by a separator in the form of a rigid body of insulation. A storage pan is mounted at the bottom of the fresh food compartment above the separator. Means are included for providing forced refrigerated air to the freezer compartment. An air flow duct selectively directs a portion of the refrigerated air from the freezer compartment to a top section of the fresh food compartment. The return system comprises a separator top disposed immediately above the separator insulation body and below the storage pan in the storage compartment, and including return means defining an air flow path for channeling return air flow. The return means includes an inlet proximate a front of the separator and an outlet proximate a rear of the separator so that the path is directly below the storage pan. An air flow passage through the separator insulation body is in communication with the outlet for returning refrigerated air to the freezer compartment.

It is a feature of the invention that the separator top is of molded or formed plastic construction.

Further features and advantages of the invention will readily be apparent from the specification and from the drawing.

BRIEF DESCRIPTION OF THE DRAWING

FIG. 6 is a sectional view taken along the line 6—6 of FIG. 5;

FIG. 7 is an exploded view of the separator of FIG. 1 according to a first embodiment of the invention;

DETAILED DESCRIPTION OF THE INVENTION

Figure 1:
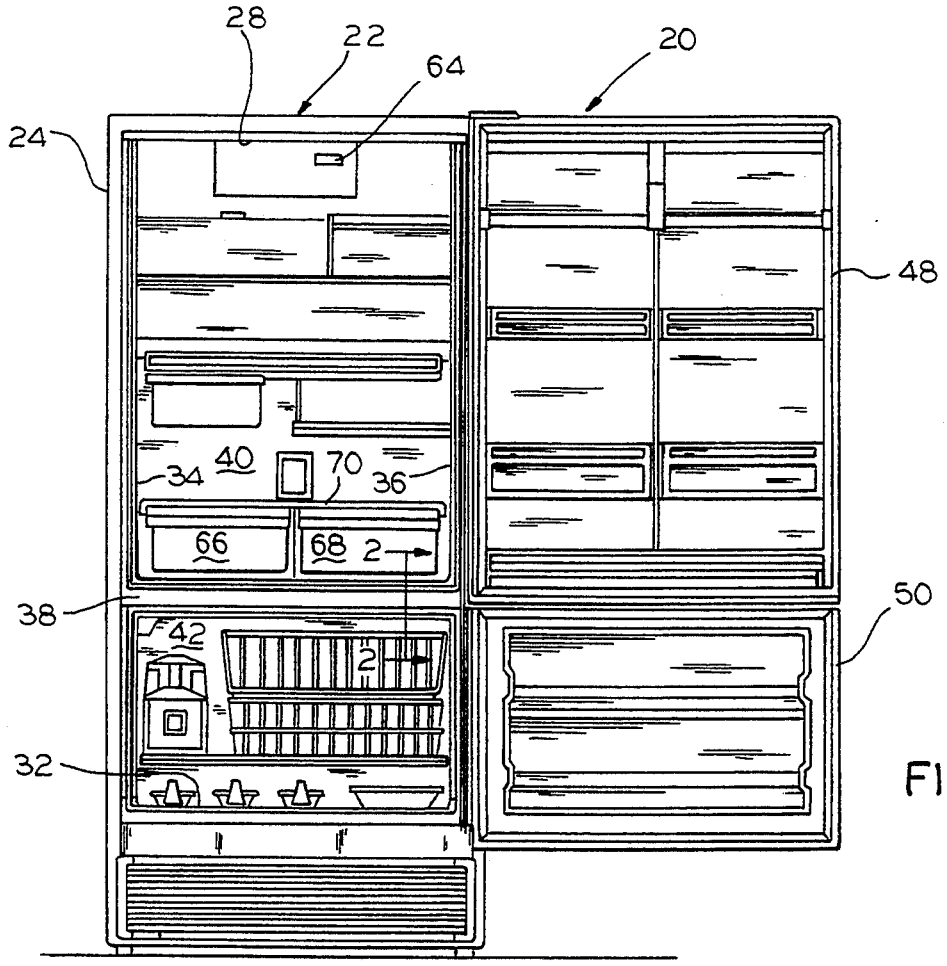
FIG. 1 is a front elevation of a refrigerator/freezer having an air return system embodying the invention.

Referring to FIG. 1, a refrigeration apparatus, such as a refrigerator/freezer, 20 includes an air return system according to the present invention.

The refrigerator/freezer 20 includes a cabinet 22 having top, rear and side walls defining an outer shell 24. A liner 26 is spaced inwardly from the shell 24. The liner 26 includes a top wall 28, a back wall 30, a bottom wall 32, and opposite side walls 34 and 36. A partition in the form of a separator 38 divides the cabinet 22 into an upper fresh food compartment 40 and a lower freezer compartment 42. The separator 38 includes a spaced apart separator top 44, that defines a lower wall of the fresh food compartment 40, and a separator bottom 46, that defines an upper wall of the freezer compartment 42. A fresh food door 48 is hingedly mounted to the cabinet 22 to provide selective access to the fresh food compartment 40. A freezer door 50 is hingedly mounted to the cabinet 22 to provide selected access to the freezer compartment 42.

In an alternative configuration, the fresh food compartment 40 and the freezer compartment 42 use separate tubs or liners. The adjacent bottom wall of the fresh food liner and top wall of the freezer liner form the "separator".

Figure 3:
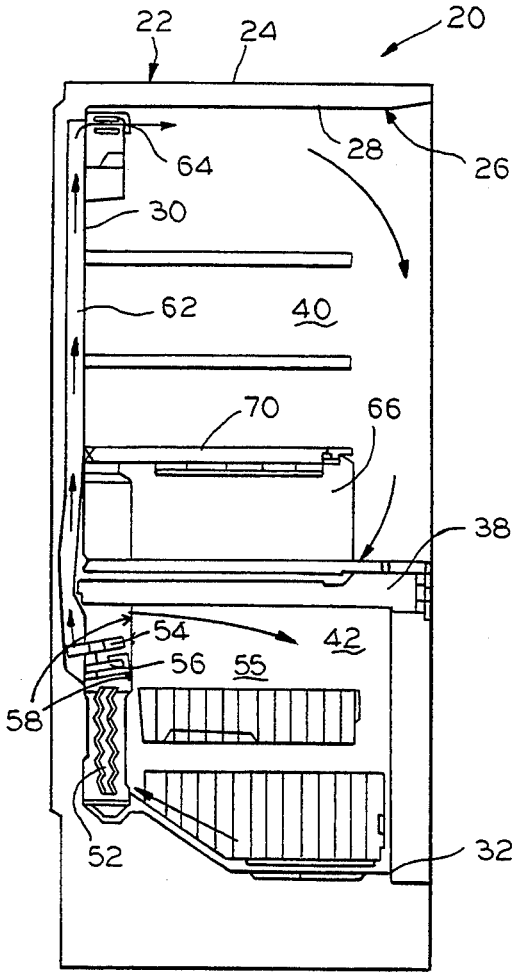
FIG. 3 is a cut away side view of the refrigerator/-freezer of FIG. 3 illustrating the path of air circulation in the cabinet.
Figure 4:
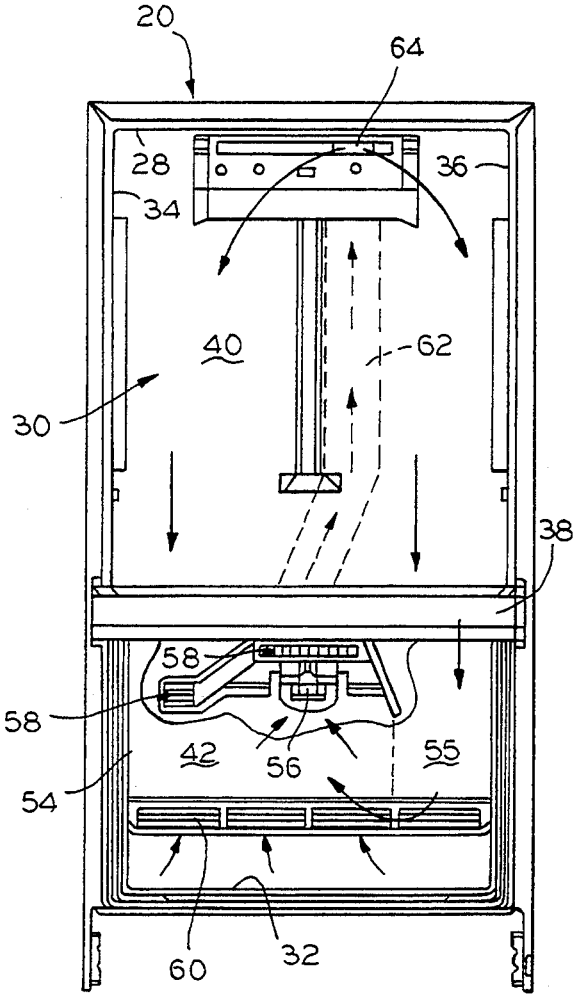
FIG. 4 is a front elevation of the refrigerator/freezer of FIG. 1, with parts removed for clarity, also illustrating the air circulation in the cabinet.
Figure 5:
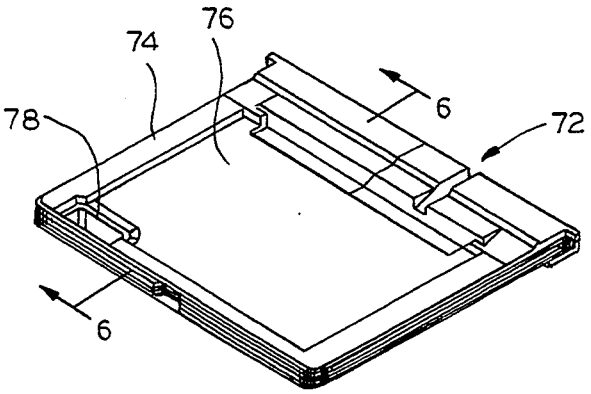
FIG. 5 is a perspective view of a body of insulation for a compartment separator of the refrigerator/freezer of FIG. 1.
Figure 8:
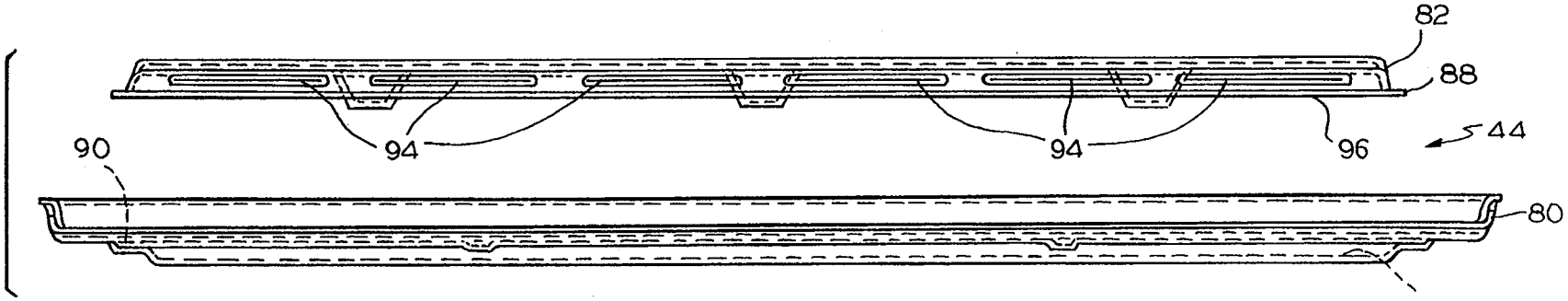
FIG. 8 is an exploded elevation view of a separator top for the separator of FIG. 1.
Figure 10:
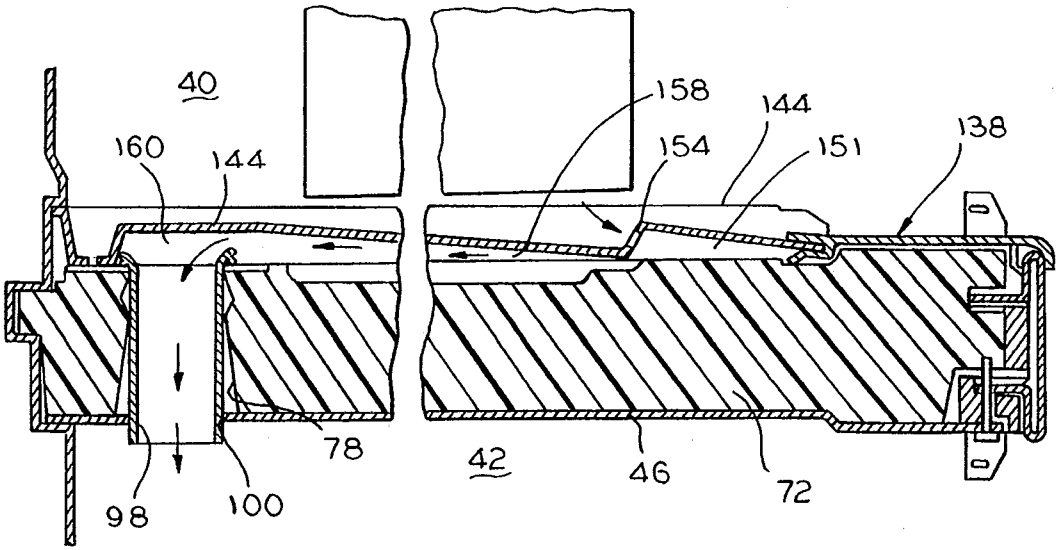
FIG. 10 is a sectional view, similar to that of FIG. 2, for a separator according to an alternative embodiment of the invention.
Figure 9:
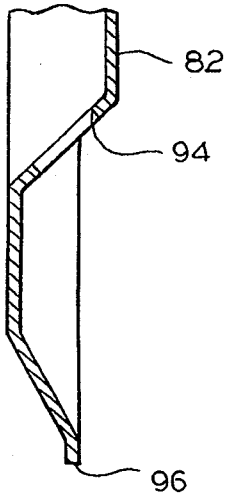
FIG. 9 is a sectional view taken along the line 9—9 of FIG. 7.
Figure 11:
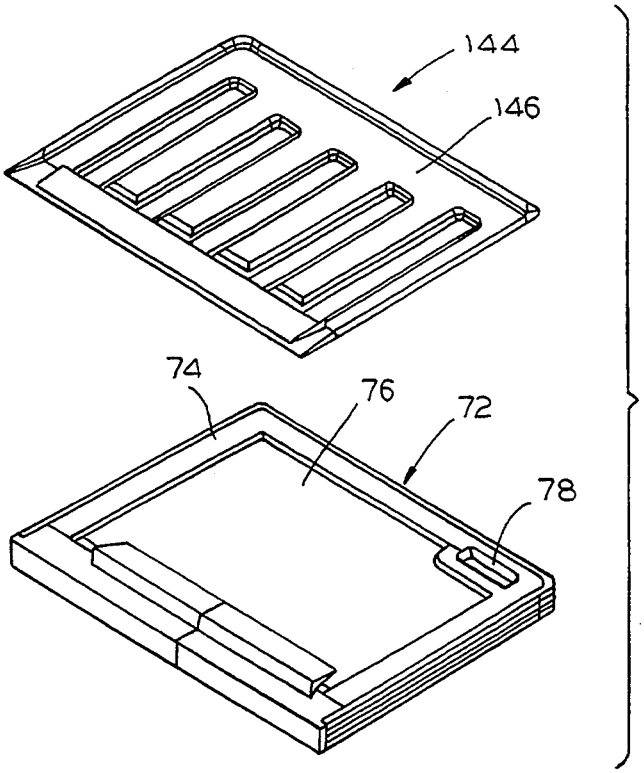
FIG. 11 is an exploded view of the separator of the embodiment of FIG. 10.
Figure 12:
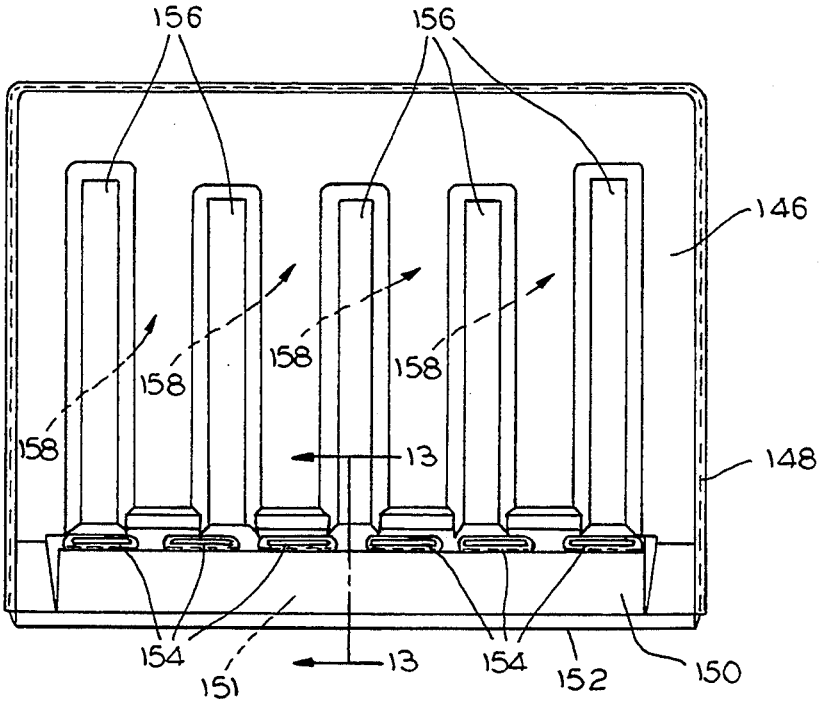
FIG. 12 is a plan view of a separator top for the embodiment of FIG. 10.
Figure 13:
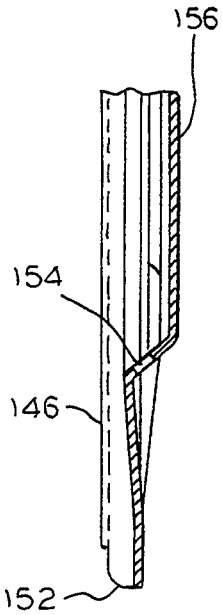
FIG. 13 is a sectional view taken along the line 13—13 of FIG. 12.

Referring particularly to FIGS. 3 and 4, an evaporator coil 52 is provided at the rear of the freezer compartment 42. A divider wall 54 forwardly of the evaporator coil 52 provides a back wall for a storage space 55 of the freezer compartment 42. An evaporator fan 56 located above the evaporator coil 52 draws air across the evaporator coil 52 to provide refrigerated air for cooling the compartments 40 and 42. Suitable openings 58 are provided for delivering refrigerated air from the evaporator fan 54 into the freezer compartment 42. Suitable openings 60 are provided in a lower portion of the back wall 54 for conducting air from the freezer compartment 42 back to the evaporator coil 52. The arrows in the freezer compartment 42 represent refrigerated air circulated therein. A passageway in the form of a vertical duct 62 associated with the liner rear wall 30 delivers a portion of the refrigerated air from the evaporator fan 54 to the fresh food compartment 40. The duct 62 is in communication with an air diffuser 64 centrally located along the liner rear wall 30 immediately below the liner top wall 28. Although not shown, an adjustable damper may be provided to adjust the amount of air which is delivered into the fresh food compartment 40, as is well known.

Within both the fresh food compartment 40 and the freezer compartment 42 are provided a plurality of shelves and other structure for supporting and storing food articles therein. At the bottom of the fresh food compartment 40 are two crisper or storage pans 66 and 68, arranged side-by-side and beneath a shelf 70. In accordance with the invention, an air return system is provided which channels air flow below the crisper pans 66 and 68.

With reference also to FIGS. 5–8, the separator 38 comprises a rigid insulation body 72 disposed between the separator top 44 and separator bottom 46. Particularly, the insulation body 46 is formed of expanded polystyrene of a shape and size configured as necessary for the size of the cabinet 22. The insulation body 72 is in a generally parallelepiped configuration having a top surface 74 with a depressed central portion defining a cavity 76. A passage 78 extends through the body 72 proximate a right rear corner thereof when viewed from the front.

Figure 2:
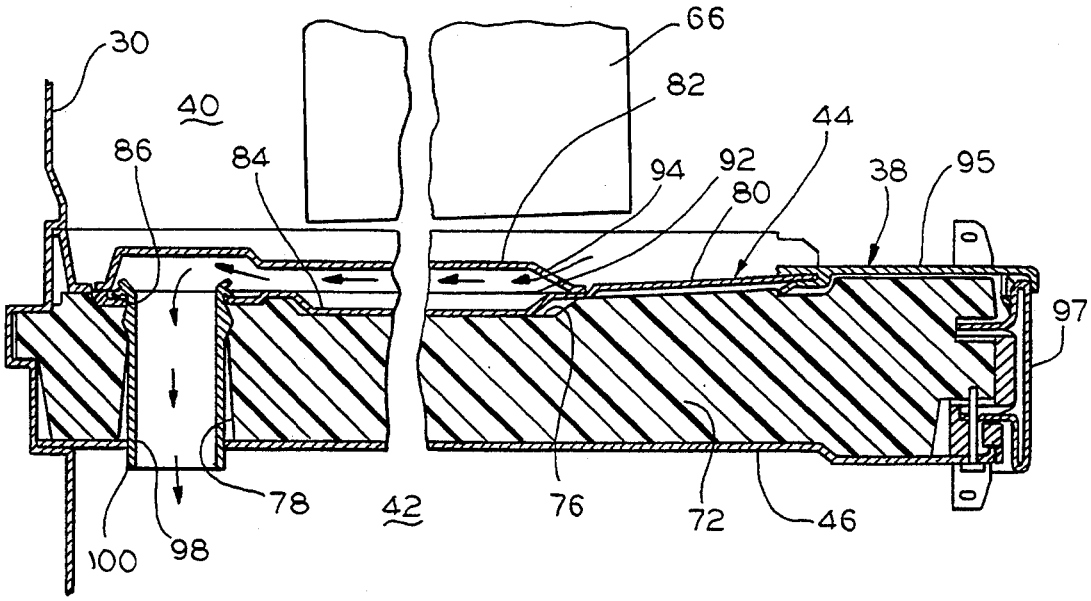
FIG. 2 is a partial, sectional view taken along the line 2—2 of FIG. 1.

The separator top 44 is of two-piece construction comprising a first wall 80 and a second wall 82. Each of the walls 80 and 82 is molded or formed of plastic such as ABS or HIPS. The first wall 80 is of a size and shape generally corresponding to the insulation body top surface 74 and includes a central cavity 84. The first wall 80 is positioned directly atop the insulation body 72 with its cavity 84 received in the insulation body cavity 76, as illustrated in FIG. 2. The first wall 84 includes an opening 86 overlying the insulation body opening 78. The second wall 82 is positioned atop the first wall 80. Particularly, an outer peripheral edge 88 of the second wall 82 is seated atop an outer peripheral edge 90 of the first wall cavity 84. This structure provides a space 92 between the first wall 80 and second wall 82 to define an air flow return path or channel. A plurality of openings 94 are provided proximate a front edge 96 of the second wall 82 providing a return air inlet. Suitable trim pieces 95 and 97 are included at a front of the separator 38, as is well known.

A molded tubular element 98 is snap-fit to the first wall opening 86, see FIG. 2, and extends through the insulation body opening 78 and a corresponding opening 100 in the separator bottom 46. Thus, the second wall opening 86 and tubular elements 98 define a return air outlet from the space 92.

Owing to the above-described configuration, the arrows shown in the refrigeration compartment 40 of FIGS. 3 and 4 represent refrigerated air circulated therein which is returned to the freezer compartment 42 through the return air inlet openings 94 into the space 92, and then through the second wall opening 86 and tubular element 98 into the freezer compartment 42, see the arrows of FIG. 2. The channeling of the return air between the first and second walls 80 and 82 provides an insulating layer of air flowing under the crisper pans 66 and 68, eliminating the requirement for a separate heater. Further, the air circulation path within the fresh food compartment favors air flow to the front of the separator 38 to improve air flow over items stored in the fresh food compartment door 48.

With reference to FIGS. 10–13, a separator 138 according to an alternative embodiment of the invention is illustrated. The separator 138 uses the same insulation body 72 and separator bottom 46 as in the embodiment discussed above. The difference lies in the use of a one-piece separator top 144.

For simplicity herein, the separator 138 according to the alternative embodiment uses similar reference numerals to that discussed above, increased by the number 100 for simple comparison therebetween.

The separator top 144 is of one-piece construction molded or formed of plastic such as ABS or HIPS. The separator top 144 is of a generally rectangular planar configuration similar in size to the separator first wall 80, discussed above. However, instead of being adapted to conform to the shape of the insulation body 72, the separator 144 includes a generally planar wall 146 turned downwardly to provide an outer peripheral flange 148. A raised manifold 150 is provided immediately rearwardly of a front edge 152 and includes a plurality of rearwardly facing openings 154 opening into a manifold space 151. A plurality of downwardly extending sumped areas 156 are formed in the planar wall 146 to define air channels 158 therebetween. The air channels 158 communicate with the manifold space 151.

The separator top 144 is positioned atop the insulation body 72. The tubular element 100 is received in the insulation body opening 78. A space 160 is provided between the separator top 144 and the insulation body 72 formed by the channels 158. Particularly, return air enters through the openings 154 into the channels 158 and space 160, which passes through the tubular element 100 to return to the freezer compartment 42.

With either embodiment illustrated above, the separator top 44 or 144 is held to the insulation body 72 owing to a proper fit within suitable slots (not shown) in the liner side walls 34 and 36.

The separator top 144 provides similar benefits to that discussed above relative to the separator top 44, namely, providing an air return passing below the crisper pans 66 and 68 to prevent freezing thereof.

The foregoing disclosure is illustrative of the broad inventive concepts comprehended by the invention.

We claim:

1. In a refrigeration apparatus including a cabinet defining a fresh food compartment above a freezer compartment separated by an insulated separator, means for providing refrigerated air to said freezer compartment, and air flow control means for selectively directing a portion of said refrigerated air to said fresh food compartment, an improved air return system comprising:

a separator top operatively associated with said separator in the fresh food compartment and including return means defining an air flow path for channeling return air flow, said return means including an inlet proximate a front of the separator and an outlet proximate a rear of the separator; and an air flow passage through said separator in communication with said outlet for returning refrigerated air to said freezer compartment.

2. The air return system of claim 1 wherein separator top comprises a one piece wall positioned atop said separator and defining an air space therebetween and said inlet comprises an opening in said wall proximate a front edge of said wall.

3. The air return system of claim 1 wherein separator top comprises a first wall positioned atop said separator and a second wall positioned atop said first wall defining an air space therebetween and said inlet comprises an opening in said second wall proximate a front edge of said second wall.

4. The air return system of claim 3 wherein said outlet comprises an opening in said first wall proximate a rear edge of the first wall.

5. The air return system of claim 4 further comprising a tubular element connected to said first wall at said outlet and extending through the air flow passage.

6. In a refrigeration apparatus including a cabinet defining a fresh food compartment above a freezer compartment separated by a separator in the form of a rigid body of insulation, a storage pan mounted at a bottom of the fresh food compartment above said separator, means for providing forced refrigerated air to said freezer compartment, and an air flow duct for selectively directing a portion of said refrigerated air from said freezer compartment to a top section of said fresh food compartment, an improved air return system comprising:

a separator top disposed immediately above said separator insulation body and below said storage pan in the fresh food compartment and including return means defining an air flow path for channeling return air flow, said return means including an inlet proximate a front of the separator and an outlet proximate a rear of the separator so that said path is directly below the storage pan; and an air flow passage through said separator insulation body in communication with said outlet for returning refrigerated air to said freezer compartment.

7. The air return system of claim 6 wherein separator top comprises a one piece wall positioned atop said separator insulation body and defining an air space therebetween and said inlet comprises an opening in said wall proximate a front edge of said wall.

8. The air return system of claim 6 wherein separator top comprises a first wall positioned atop said separator insulation body and a second wall positioned atop said first wall defining an air space therebetween and said inlet comprises an opening in said second wall proximate a front edge of said second wall.

9. The air return system of claim 8 wherein said outlet comprises an opening in said first wall proximate a rear edge of the first wall.

10. The air return system of claim 9 further comprising a tubular element connected to said first wall at said outlet and extending through the air flow passage.

11. The air return passage of claim 6 wherein said separator top is of molded plastic construction.

12. The air return passage of claim 11 wherein said separator top is of molded HIPS plastic construction.

13. The air return passage of claim 11 wherein said separator top is of molded ABS plastic construction.

14. The air return passage of claim 6 wherein said separator top is of formed plastic construction.

* * * * *